US006527359B1

(12) United States Patent
Otsuki

(10) Patent No.: US 6,527,359 B1
(45) Date of Patent: Mar. 4, 2003

(54) MISREGISTRATION CORRECTION FOR BIDIRECTIONAL PRINTING WITH REDUCED INFLUENCE OF ERROR DUE TO VERTICAL SCANNING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/787,897

(22) PCT Filed: Jul. 25, 2000

(86) PCT No.: PCT/JP00/04952

§ 371 (c)(1),
(2), (4) Date: Mar. 28, 2001

(87) PCT Pub. No.: WO01/10648

PCT Pub. Date: Feb. 15, 2001

(30) Foreign Application Priority Data

Aug. 3, 1999 (JP) ..... 11-219691

(51) Int. Cl.[7] ..... B41J 19/14; B41J 29/393
(52) U.S. Cl. ..... 347/19; 347/12
(58) Field of Search ..... 347/12, 19, 37, 347/39, 40, 43; 400/74

(56) References Cited

U.S. PATENT DOCUMENTS

| | | | | | |
|---|---|---|---|---|---|
| 4,672,432 | A | * | 6/1987 | Sakurada et al. | 347/43 |
| 5,530,460 | A | | 6/1996 | Wehl | 347/19 |
| 6,039,427 | A | * | 3/2000 | Kanome | 347/19 |
| 6,082,911 | A | * | 7/2000 | Murakami | 400/74 |
| 6,084,606 | A | * | 7/2000 | Moriyama | 347/19 |
| 6,109,721 | A | * | 8/2000 | Kim | 347/19 |
| 6,109,722 | A | * | 8/2000 | Underwood et al. | 347/19 |
| 6,196,736 | B1 | * | 3/2001 | Otsuki et al. | 400/124.01 |
| 6,322,191 | B1 | * | 11/2001 | Seshimo et al. | 347/19 |
| 6,367,903 | B1 | * | 4/2002 | Gast et al. | 347/9 |

FOREIGN PATENT DOCUMENTS

| | | | | |
|---|---|---|---|---|
| EP | 744706 A2 | * | 11/1996 | G06K/15/11 |
| EP | 0 867 298 | | 9/1998 | |
| EP | 0 895 869 | | 2/1999 | |
| EP | 982 139 | * | 3/2000 | B41J/2/21 |
| EP | 1 112 851 | | 7/2001 | |
| JP | 63-141780 | | 6/1988 | |
| JP | 5-69625 | | 3/1993 | |
| JP | 7-25101 | | 1/1995 | |
| JP | 2000-062156 | | 2/2000 | |
| JP | 2000-127370 | | 5/2000 | |
| JP | 2000-141624 | | 5/2000 | |

* cited by examiner

*Primary Examiner*—John Barlow
*Assistant Examiner*—Blaise Mouttet
(74) *Attorney, Agent, or Firm*—Oblon, Spivak, McClelland, Maier & Neustadt, P.C.

(57) ABSTRACT

The technique of the present invention prints positional misalignment test pattern with a nozzle group without sub-scan feed. The positional misalignment test pattern includes a rear test sub-pattern and a front test sub-pattern printed at different positions shifted in a sub-scanning direction. The rear test sub-pattern is printed with a rear nozzle sub-group, whereas the front test sub-pattern is printed with a front nozzle sub-group. The technique determines a correction value according to correction information that represents a favorable correction state selected based on the printed positional misalignment test pattern, and then actually corrects misalignment of recording positions in a main scanning direction occurring in bidirectional printing, using the correction value thus determined.

21 Claims, 9 Drawing Sheets

MISREGISTRATION CORRECTION FOR BIDIRECTIONAL PRINTING WITH REDUCED INFLUENCE OF ERROR DUE TO VERTICAL SCANNING

TECHNICAL FIELD

The present invention relates to a technique that carries out bidirectional, reciprocating main scan to prints an image on a printing medium. More specifically the present invention pertains to a technique that adjusts misalignment of dot recording positions in a main scanning direction between a forward pass and a backward pass of the main scan.

BACKGROUND ART

Recently color printers having a print head that ejects a plurality of different color inks have been widely used as an output device of computers. Some of such color printers have the function of "bidirectional printing" for the purpose of enhanced printing speed.

In bidirectional printing, misalignment of recording positions in a main scanning direction between a forward pass and a backward pass of main scan often arises due to backlash of a driving mechanism in the main scanning direction or a warp of a platen that supports a printing medium thereon. One of the known techniques proposed to relieve such positional misalignment is disclosed in JPA 5-69625 filed by the applicant of the present invention. This prior art technique registers in advance a potential amount of positional misalignment (deviation in printing) in the main scanning direction and adjusts the dot recording positions on the forward pass and on the backward pass, based on the registered amount of positional misalignment.

One of the applicable methods to adjust the recording positions in the main scanning direction actually prints a specific test pattern on the printing medium, and specifies the amount of positional misalignment in the main scanning direction based on the printed result of the specific test pattern, so as to determine the correction value. The process of printing the specific test pattern to specify the amount of positional misalignment generally accompanies sub-scan. The sub-scan feed may, however, cause deviation of the dot recording positions in the main scanning direction, due to backlash of a sub-scan driving mechanism or any inclined feed of the printing medium. The greater feeding amount and the greater number of feeds in the sub-scanning direction generally cause more significant misalignment of recording positions. Namely a large number of feeds in the sub-scanning direction by a large feeding amount in the process of printing the specific test pattern to specify the amount of positional misalignment in the main scanning direction undesirably causes error due to the sub-scan feed to be reflected on the printed result. This makes it difficult to accurately specify the amount of positional misalignment in the main scanning direction.

The object of the present invention is to solve the problem of the prior art technique discussed above and accordingly to provide a technique that relieves positional misalignment in the main scanning direction between a forward pass and a backward pass of main scan with regard to a nozzle array in a bidirectional printing apparatus.

DISCLOSURE OF THE INVENTION

In order to attain at least part of the above and the other related objects, one technique of the present invention prints positional misalignment test pattern with a nozzle group without sub-scan feed. The technique determines a correction value according to correction information that represents a favorable correction state selected based on the printed positional misalignment test pattern, and then actually corrects misalignment of recording positions in a main scanning direction occurring in bidirectional printing, using the correction value thus determined.

The sub-scan feed in the course of printing the "positional misalignment test pattern" causes working error of each mechanism relating to the sub-scan feed to be reflected on the printed "positional misalignment test pattern." This makes the correction value include some error. The arrangement of the present invention, however, prints the "positional misalignment test pattern" without any feed in the sub-scanning direction, thus preventing any such problem. This arrangement thus enables the correction value to be determined accurately, based on the properly printed "positional misalignment test pattern."

Another technique of the present invention prints a front test sub-pattern with a front nozzle sub-group on a printing medium on a selected one of the forward pass and the backward pass of the main scan of the print head. Here the front nozzle sub-group is part of the nozzle group and includes nozzles located in a relatively forward section of the nozzle group in a sub-scanning direction. The technique also prints a rear test sub-pattern with a rear nozzle sub-group on the printing medium on the other of the forward pass and the backward pass of the main scan of the print head. Here the rear nozzle sub-group is part of the nozzle group and includes nozzles located in a relatively backward section of the nozzle group in the sub-scanning direction. The technique subsequently determines a correction value according to correction information that represents a favorable correction state selected based on positional misalignment test pattern. Here the positional misalignment test pattern includes the rear test sub-pattern and the front test sub-pattern printed at different positions shifted in the sub-scanning direction. The technique then actually corrects using the correction value the misalignment of recording positions in the main scanning direction occurring in bidirectional printing thus determined. The "forward (section) in the sub-scanning direction" represents a direction from the print head, which moves relative to the printing medium, to the part of the printing medium that has not yet scanned by the print head. The "backward (section) in the sub-scanning direction" is just opposite to the "forward (section) in the sub-scanning direction."

This arrangement of the present invention enables the rear test sub-pattern and the front test sub-pattern, which are shifted in the sub-scanning direction, to be printed without any feed of the print head in the sub-scanning direction. The resulting "positional misalignment test pattern" is thus printed with little error and enables the user to readily select a favorable correction state and accurately determine the correction value according to the selected favorable correction state. In the above application, the "positional misalignment test pattern" is printed without any feed of the print head in the sub-scanning direction. One modified application may print the "positional misalignment test pattern" with small feeds in the sub-scanning direction, for the purpose of facilitating the determination of the correction value.

The following configuration is preferable when the nozzle group includes a low density nozzle group that forms only noncontiguous dots in the sub-scanning direction at a predetermined recording density on the printing medium by one pass of the main scan. The memory stores a first correction value therein, where the first correction value is used to correct misalignment of recording positions in the main scanning direction on the forward pass and the backward pass of the main scan with regard to the low density nozzle group. The first correction value is determined according to correction information that represents a favorable correction state selected based on a first positional misalignment test pattern. Here the first positional misalignment test pattern includes a first front test sub-pattern and a first rear test sub-pattern printed with the low density nozzle group at different positions shifted in the sub-scanning direction. The first front test sub-pattern includes a plurality of vertical ruled lines that extend in the sub-scanning direction and are formed using a first front nozzle sub-group by repeatedly carrying out a selected one of the forward pass and the backward pass of the main scan of the print head in combination with sub-scan feeds interposed between the main scan passes. Here the first front nozzle sub-group is part of the low density nozzle group and includes nozzles located in a relatively forward section of the low density nozzle group in the sub-scanning direction. The first rear test sub-pattern includes a plurality of vertical ruled lines that extend in the sub-scanning direction and are formed using a first rear nozzle sub-group by repeatedly carrying out the other of the forward pass and the backward pass of the main scan of the print head in combination with sub-scan feeds interposed between the main scan passes. Here the first rear nozzle sub-group is part of the low density nozzle group and includes nozzles located in a relatively backward section of the low density nozzle group in the sub-scanning direction. In this application, the printing apparatus may have a plurality of the low density nozzle groups, and the memory may store a plurality of the first correction values.

In this application, the "first rear test sub-pattern" and the "first front test sub-pattern" respectively consist of vertical ruled lines of contiguous dots in the sub-scanning direction. The "first correction value", which is used to correct the misalignment of recording positions in the main scanning direction, is thus readily determined, based on the "first rear test sub-pattern" and the "first front test sub-pattern." This printing process accompanies some feeds in the sub-scanning direction to make the dots contiguous in the sub-scanning direction. But no large feeds in the sub-scanning direction are required to print the "rear test sub-pattern" and the "front test sub-pattern" at the different positions shifted in the sub-scanning direction. The resulting "positional misalignment test pattern" is printed with little error and enables the user to accurately determine the correction value based on the printed "positional misalignment test pattern."

It is preferable that the feeding amount of sub-scan in printing the first positional misalignment test pattern is equal to one dot pitch. The feeds in the sub-scanning direction by one dot between the consecutive passes of the main scan enable continuous dots to be printed even with the low density nozzle group that creates only noncontiguous dots in the sub-scanning direction by one pass of the main scan. The feed in the sub-scanning direction is the one dot space, so that the "positional misalignment test pattern" can be printed with a small summation of the feeds in the sub-scanning direction. This reduces the error of the feed in the sub-scanning direction. The resulting "positional misalignment test pattern" is thus printed with little error and enables the user to accurately determine the correction value based on the printed "positional misalignment test pattern."

The following configuration is preferable when the nozzle group includes a high density nozzle group that forms contiguous dots in the sub-scanning direction at a predetermined recording density on the printing medium by one pass of the main scan. The memory stores a second correction value therein, where the second correction value is used to correct misalignment of recording positions in the main scanning direction on the forward pass and the backward pass of the main scan with regard to the high density nozzle group. The second correction value is determined according to correction information that represents a favorable correction state selected based on a second positional misalignment test pattern. Here the second positional misalignment test pattern includes a second front test sub-pattern and a second rear test sub-pattern printed with the high density nozzle group at different positions shifted in the sub-scanning direction. The second front test sub-pattern includes a plurality of vertical ruled lines of continuous dots that extend in the sub-scanning direction and are formed using a second front nozzle sub-group on a selected one of the forward pass and the backward pass of the main scan of the print head. Here the second front nozzle sub-group is part of the high density nozzle group and includes nozzles located in a relatively forward section of the high density nozzle group in the sub-scanning direction. The second rear test sub-pattern includes a plurality of vertical ruled lines of continuous dots that extend in the sub-scanning direction and are formed using a second rear nozzle sub-group on the other of the forward pass and the backward pass of the main scan of the print head. Here the second rear nozzle sub-group is part of the high density nozzle group and includes nozzles located in a relatively backward section of the high density nozzle group in the sub-scanning direction. The second positional misalignment test pattern is printed without sub-scan feed.

In this application, the nozzle group can form contiguous dots in the sub-scanning direction at a predetermined recording density on the printing medium by one pass of the main scan. In this arrangement, the printing apparatus can print the "second rear test sub-pattern" and the "second front test sub-pattern", which respectively include vertical ruled lines extending in the sub-scanning direction, without any feed of sub-scan. The resulting "positional misalignment test pattern" is thus printed with little error and enables the user to determine the correction value accurately according to the positional misalignment test pattern.

In accordance with one preferable embodiment, the misalignment of recording positions in the main scanning direction occurring in bidirectional printing, is corrected using a mean of the first correction value and the second correction value. In this embodiment, there may be a plurality of the low density nozzle groups and a plurality of the high density nozzle groups.

The technique of the embodiment carries out proper correction, based on both the first correction value, which reflects the characteristics of the low density nozzle group, and the second correction value, which reflects the characteristics of the high density nozzle group. The arrangement carries out the correction with the mean of the first correction value and the second correction value. This enables the characteristics of both the low density nozzle group and the high density nozzle group to be readily reflected on the correction.

In accordance with one preferable application, the high density nozzle group ejects black ink and the low density nozzle group includes a plurality of chromatic color nozzle groups, where each chromatic color nozzle group ejects a chromatic color ink. In this application, the first correction value is determined individually for at least one chromatic color nozzle group selected among the plurality of chromatic color nozzle groups. The positional misalignment correction unit may correct the misalignment of recording positions in the main scanning direction occurring in bidirectional printing using a mean of at least two correction values selected out of the second correction value and the at least one first correction value determined for the at least one selected chromatic color nozzle group, in a specific print mode in which nozzles in the low density nozzle group are used.

In the case of color printing with the low density nozzle group, the misalignment of recording positions can be readily corrected using the mean of the first correction values and the second correction value. Each of the first correction values reflects the characteristics of each chromatic color nozzle group, and the second correction value reflects the characteristics of the high density nozzle group ejecting black ink. The chromatic color nozzle groups that are taken into account for and added to the calculation of the "mean" may be selected based on the position of nozzles in the chromatic color nozzle group and the conspicuousness of the misalignment of recording positions by the nozzle group. This ensures correction suitable for color printing. The "chromatic color nozzle group" of which the first correction value is set may be the same chromatic color nozzle groups that are taken into account for and added to the calculation of the "mean."

In accordance with another preferable application, the first correction value is determined for at least one chromatic color nozzle group selected among the plurality of chromatic color nozzle groups. The positional misalignment correction unit may correct the misalignment of recording positions using one of the first correction value in a specific print mode in which nozzles in the low density nozzle group are used.

In the case of color printing with the low density nozzle group, this application corrects the misalignment of recording positions using the first correction value, which reflects the characteristics of one chromatic color nozzle group included in the low density nozzle group. This chromatic color nozzle group may be appropriately selected by considering the position of nozzles in the chromatic color nozzle group and the conspicuousness of the misalignment of recording positions by the chromatic color nozzle group. This ensures correction suitable for color printing.

In accordance with still another preferable application, the high density nozzle group ejects black ink, and the low density nozzle group includes a plurality of chromatic color nozzle groups, where each chromatic color nozzle group ejects a chromatic color ink. The positional misalignment correction unit may correct the misalignment of recording positions using the second correction value in a specific print mode in which nozzles in the low density nozzle group are not used. In the case of monochromatic printing, this application carries out correction with the second correction value, which reflects the characteristics of the high density nozzle group. This accordingly ensures adjustment of recording positions suitable for monochromatic printing.

In accordance with another preferable application, the positional misalignment correction unit may correct the misalignment of recording positions using the first correction value with regard to the low density nozzle group, and using the second correction value with regard to the high density nozzle group. This arrangement ensures the correction optimum for both the low density nozzle group and the high density nozzle group in the course of one identical printing operation.

The present invention is realized by a diversity of applications as given below:

(1) Bidirectional printing apparatus;

(2) Method of bidirectional printing;

(3) Method of correcting misalignment of recording positions in the course of bidirectional printing;

(4) Computer programs for implementing any of the above apparatus and methods;

(5) Recording media in which computer programs for implementing any of the above apparatus and methods is recorded; and (6) Data signals that include computer programs for implementing any of the above apparatus and methods and are embodied in carrier waves.

BEST MODES OF CARRYING OUT THE INVENTION

A. Structure of Apparatus

Figure 1:
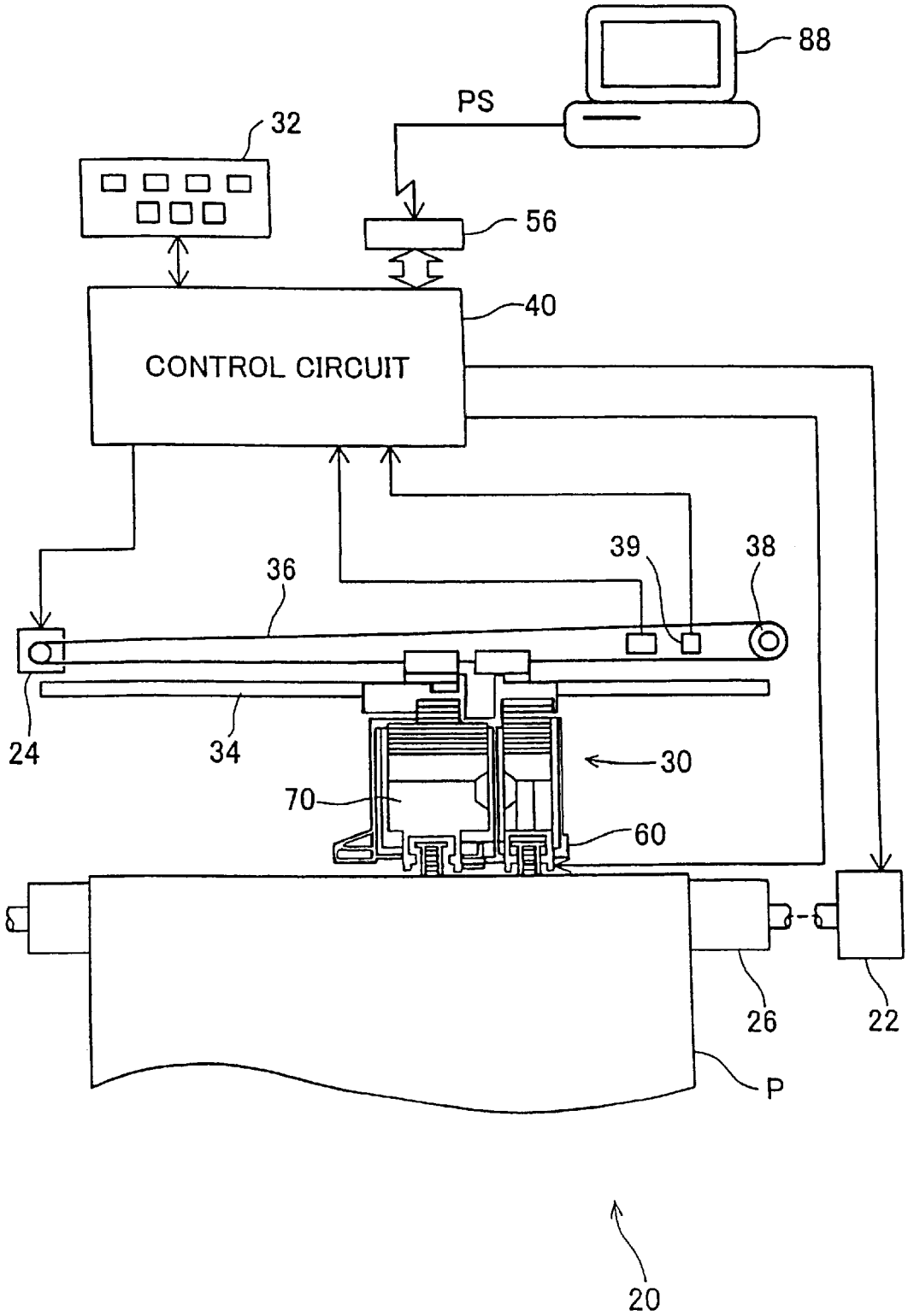
FIG. 1 schematically illustrates the structure of a printing system including an ink jet printer 20 in a first embodiment.

Some modes of carrying out the present invention are described below as preferred embodiments. FIG. 1 schematically illustrates the structure of a printing system including an ink jet printer 20 in a first embodiment of the present invention. The printer 20 includes a sub-scan mechanism that drives a sheet feed motor 22 to feed a sheet of printing paper P in a sub-scanning direction, a main scan mechanism that drives a carriage motor 24 to move a carriage 30 back and forth along an axis of a platen 26 (in a main scanning direction), a head driving mechanism that drives a print head unit 60 (also referred to as "print head assembly") mounted on the carriage 30 to control ejection of ink and creation of dots, and a control circuit 40 that controls transmission of signals to and from the sheet feed motor 22, the carriage motor 24, the print head unit 60, and a control panel 32. The control circuit 40 is connected to a computer 88 via a connector 56.

The sub-scan mechanism for feeding the printing paper P has a gear train (not shown) that transmits the rotations of the sheet feed motor 22 to the platen 26 and a sheet feed roller (not shown). The main scan mechanism for reciprocating the carriage 30 includes a sliding shaft 34 that is arranged in parallel with the axis of the platen 26 to support the carriage 30 in a slidable manner, a pulley 38 that is combined with the carriage motor 24 to support an endless drive belt 36 spanned therebetween, and a position sensor 39 that detects the starting position of the carriage 30.

Figure 2:
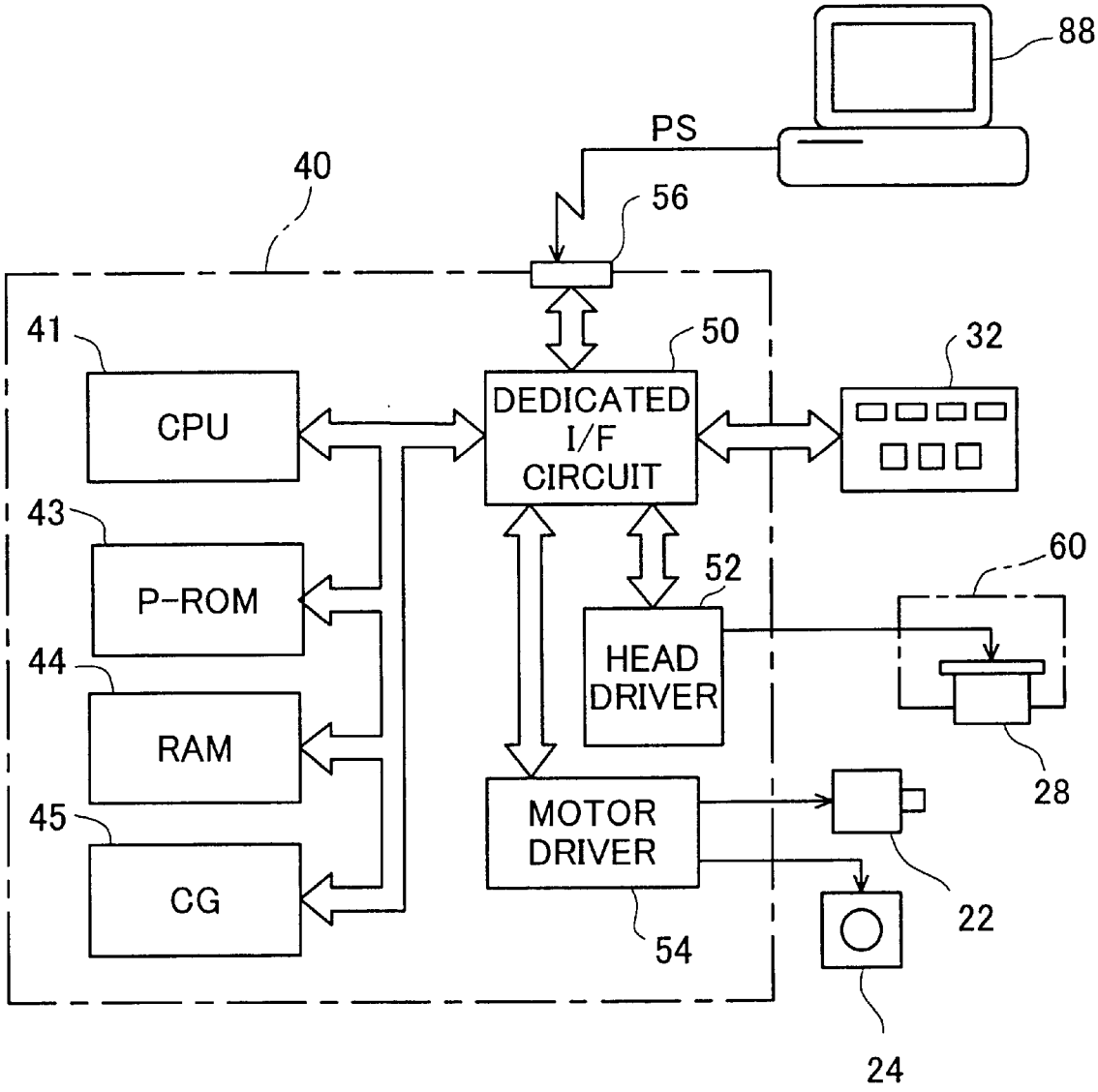
FIG. 2 is a block diagram showing the structure of a control circuit 40 included in the printer 20.

FIG. 2 is a block diagram showing the structure of the control circuit 40 included in the printer 20. The control circuit 40 is constructed as an arithmetic and logic operation circuit including a CPU 41, a programmable ROM (PROM) 43, a RAM 44, and a character generator (CG) 45 that stores dot matrixes of characters therein. The control circuit 40 further includes a dedicated I/F circuit 50 that dedicatecly works as an interface with external elements like a motor, a head driver 52 that connects with the dedicated I/F circuit 50 and drives the print head unit 60 to eject ink, and a motor driver 54 that drives the sheet feed motor 22 and the carriage motor 24. The dedicated I/F circuit 50 includes a parallel interface circuit and receives a print signal PS supplied from the computer 88 via the connector 56.

The whole configuration including the print head 28 and the mounting base of the ink cartridge 70 is called the "print head unit 60", since the print head unit 60 is attached to and detached from the printer 20 as an unitary part. Namely replacement of the print head 28 requires replacement of the print head unit 60.

Figure 3:
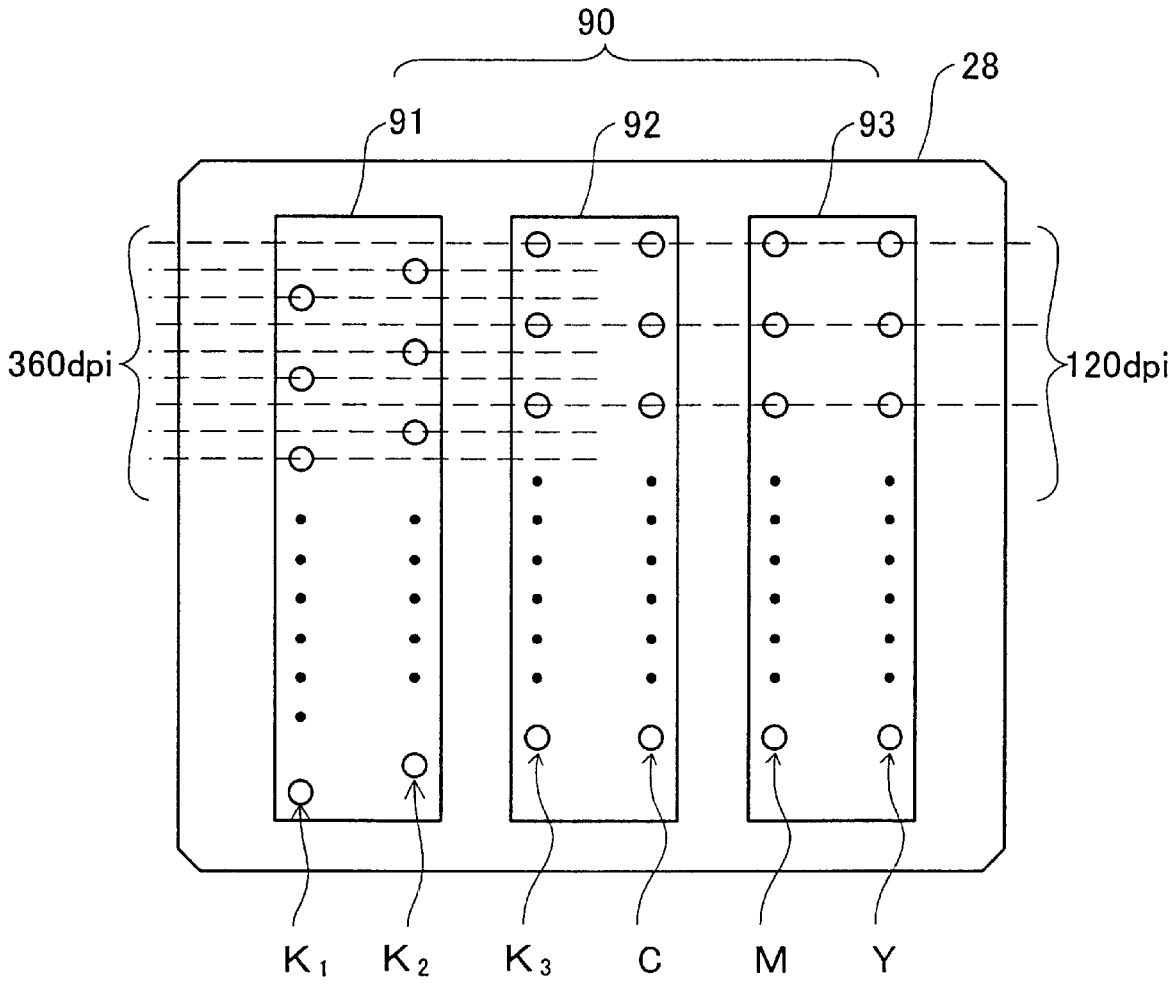
FIG. 3 shows plural actuator chips and plural nozzle arrays provided on the print head 28.

FIG. 3 shows plural actuator chips and plural nozzle arrays provided on the print head 28. The printer 20 is a printing apparatus that carries out printing with four different color inks, black (K), cyan (C), magenta (M), and yellow (Y). The print head 28 has one nozzle array for each of the three color inks, cyan (C), magenta (M), and yellow (Y). The print head 28 has also three nozzle arrays $K_1$, $K_2$, and $K_3$ for the black (K) ink. All these nozzle arrays C, M, Y, $K_1$, $K_2$, and $K_3$ have a nozzle pitch k equal to 3 dots.

This interval corresponds to 120 dpi. In the specification hereof, the cyan nozzle array C, the magenta nozzle array M, and the yellow nozzle array Y may collectively be referred to as the "color nozzle arrays CMY", and the black nozzle arrays $K_1$, $K_2$, and $K_3$ may collectively be referred to as the "black nozzle arrays K."

The nozzle arrays $K_3$, C, M, and Y are arranged such that corresponding nozzles of the respective nozzle arrays are aligned in the main scanning direction (that is, these nozzles are located at the same position in the sub-scanning direction). The respective nozzles in the nozzle array $K_2$ are located at positions shifted from those of the nozzle array $K_3$ by one dot in the sub-scanning direction, while the respective nozzles in the nozzle array $K_1$ are located at positions shifted from those of the nozzle array $K_3$ by two dots in the sub-scanning direction. With regard to each of the three colors, cyan (C), magenta (M), and yellow (Y), each pass of the main scan enables dots to be created at the maximum resolution of 120 dpi by each of the nozzle arrays C, M, and Y. With regard to black (K), on the other hand, each pass of the main scan enables dots to be created at the maximum resolution of 360 dpi by the three nozzle arrays $K_1$, $K_2$, and $K_3$, which are shifted in the sub-scanning direction.

Even in the case of printing on a printing medium at the resolution of 360 dpi, with regard to each of the three colors, cyan (C), magenta (M), and yellow (Y), each pass of the main scan attains only the 3 dot pitch printing in the sub-scanning direction. In order to print a continuous letter or figure in the sub-scanning direction at the resolution of 360 dpi, three passes of the main scan in combination with the sub-scan by the feeding amount of 1 dot are required. With regard to black (K), on the other hand, each pass of the main scan completes a print of the continuous letter or figure in the sub-scanning direction at the resolution of 360 dpi. In the technique of the present invention, the nozzle groups that can form on each pass of the main scan only intermittent dots in the sub-scanning direction on the printing medium at a predetermined recording density, for example, at 360 dpi, are regarded as the "low density nozzle groups." The nozzle groups that can form by each pass of the main scan contiguous dots in the sub-scanning direction on the printing medium at the predetermined recording density are regarded as the "high density nozzle groups."

An actuator circuit 90 includes a first actuator chip 91 for driving the black nozzle array $K_1$ and the black nozzle array $K_2$, a second actuator chip 92 for driving the black nozzle array $K_3$ and the cyan nozzle array C, and a third actuator chip 93 for driving the magenta nozzle array M and the yellow nozzle array Y.

B. Principle of Correcting Misalignment of Recording Positions in Main Scanning Direction The bidirectional printing creates dots in both the forward pass and the backward pass of the main scan to print image on the printing medium P. Accordingly, when ink is ejected aiming at the same recording position on the forward pass and on the backward pass of printing, dots should actually be recorded at the same position on the printing medium P. This is because an image can be properly reproduced by combination of dots formed in the forward pass and dots formed in the backward pass only when ink aiming at the same recording position actually forms dots at the same position on the printing medium P.

As described previously, the recording positions in the main scanning direction may be misaligned on the forward pass and the backward pass of the main scan, due to backlash of the driving mechanism in the main scanning direction or a warp of the platen that supports the printing medium thereon. This method of correcting the misalignment of recording positions intentionally shifts the ejection timings of ink droplets on the forward pass or on the backward pass from the "theoretical timings to record dots at the same recording position." This method accordingly absorbs the misalignment of recording positions and implements the correction, in order to ensure actual recording of dots at the same recording position.

C. Processing Flow of First Embodiment (1) General Processing Flow

Figure 4:
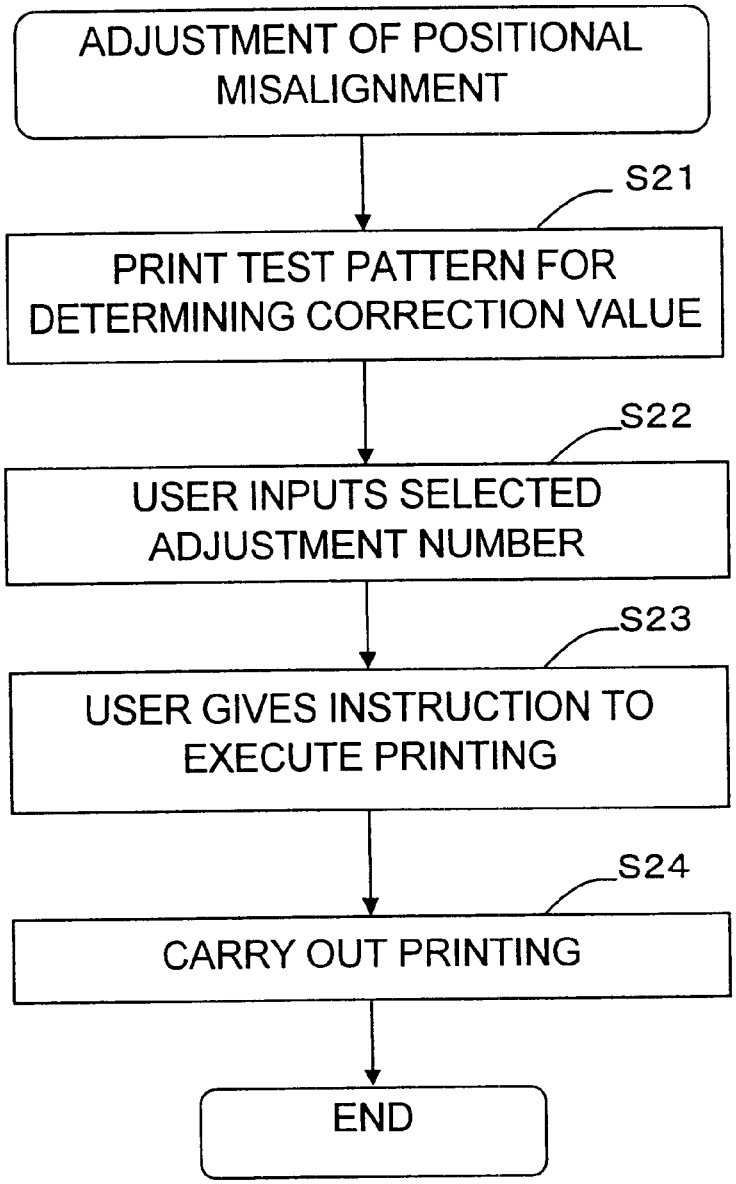
FIG. 4 is a flowchart showing a procedure of determining a correction value based on a test pattern.

FIG. 4 is a flowchart showing a procedure of adjusting the positional misalignment. This adjustment is performed by the user in principle. At step S21, test patterns for determining the correction values (positional misalignment test patterns) are printed with the printer 20. Here one test pattern is printed individually for each color. The concrete method of printing the test patterns will be discussed later.

At subsequent step S22, the user observes the test pattern printed individually for each color and inputs a misalignment adjustment number allocated to a set of vertical ruled lines having the minimum positional misalignment in the test pattern on a user interface window (not shown) of the printer driver in the computer 88 (see FIG. 2). A plurality of first adjustment numbers representing first correction values with regard to the cyan nozzle array C, the magenta nozzle array M, and the yellow nozzle array Y, and a second adjustment number representing a second correction value with regard to the black nozzle arrays K are then stored into the P-ROM 43 in the printer 20 via the computer 88 (see FIG. 2).

Figure 5:
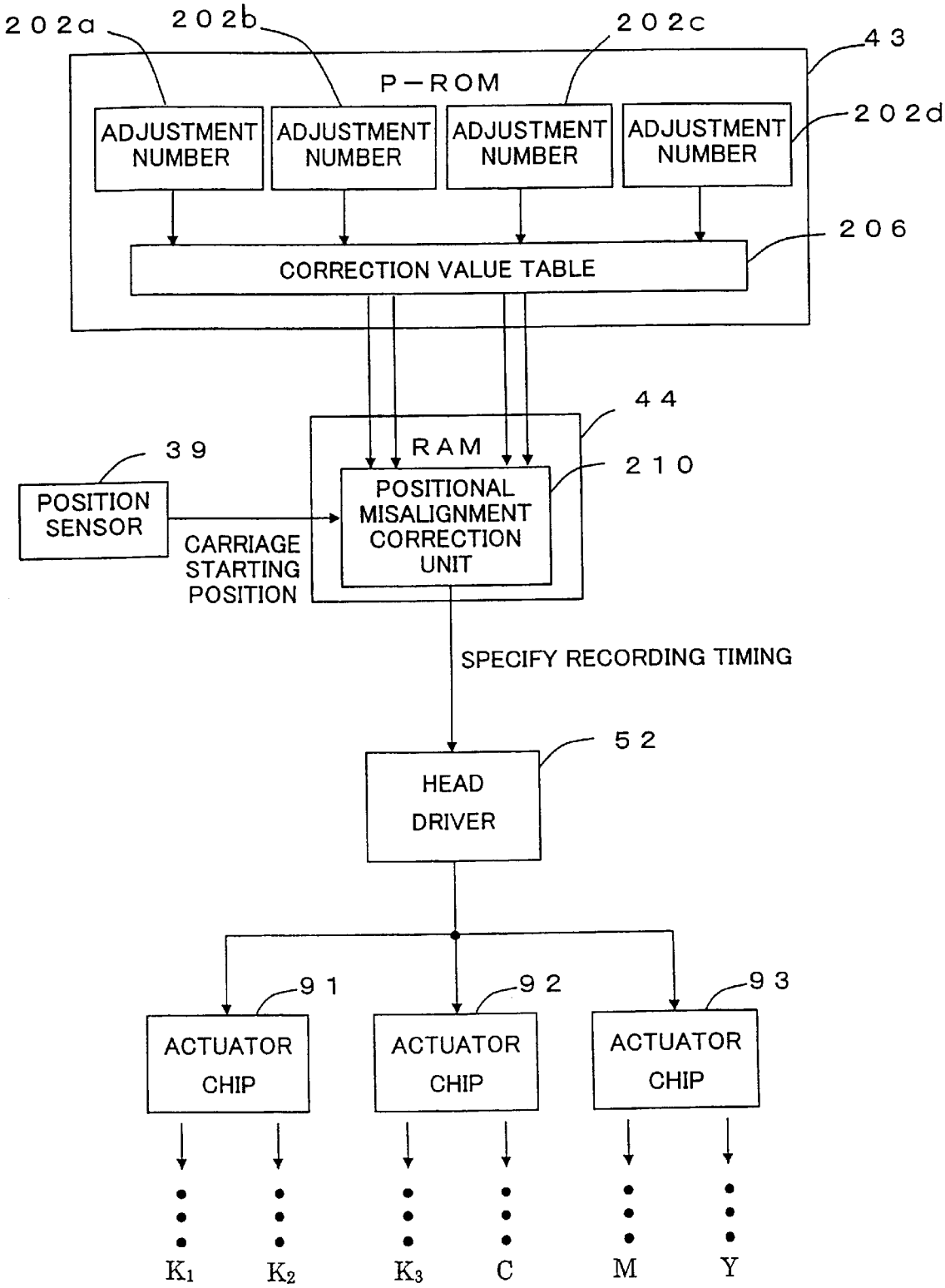
FIG. 5 is a block diagram illustrating the main configuration relating to correction of positional misalignment in bidirectional printing in the first embodiment.

At step S23, the user gives an instruction to execute printing. Then at step S24, bidirectional printing is actually carried out while the positional misalignment is corrected with the correction values. FIG. 5 is a block diagram illustrating the main configuration relating to the correction of positional misalignment in the course of bidirectional printing in the first embodiment. The P-ROM 43 in the printer 20 includes adjustment number storage areas 202*a* through 202*d* and a correction value table 206. The correction value table 206 stores the mapping of the misalignment adjustment numbers to the amounts of misalignment (that is, the correction values) of the recording position of the vertical ruled line formed by the backward pass in the test pattern.

The RAM 44 of the printer 20 stores a computer program having the function of positional misalignment correction unit 210 to correct the positional misalignment in the course of bidirectional printing. The positional misalignment correction unit 210 reads the correction value corresponding to the selected misalignment adjustment number from the correction value table 206. In the case of color printing, on the backward pass the positional misalignment correction unit 210 receives a signal representing the starting position of the carriage 30 from the position sensor 39 (FIG. 1) and supplies a timing signal for specifying a recording timing of the print head to the head driver 52 according to a comprehensive correction value, which is obtained by taking into account the second correction value and the plurality of first correction values. The head driver 52 transmits an identical driving signal to the three actuator chips 91 through 93 and adjusts the recording positions on the backward pass according to the recording timing specified by the positional misalignment correction unit 210. This causes the recording positions of the six nozzle arrays $K_1$ through Y on the backward pass to be adjusted with the common comprehensive correction value. The comprehensive correction value is calculated as the mean of the two first correction values for cyan (C) and magenta (M) and the second correction value for black (K). In the printing apparatus of the embodiment, it is here assumed that the black nozzles are used for color printing as well as the color nozzles.

In the case of monochromatic printing that does not use any color inks, it is preferable to correct the positional misalignment with only the second correction value. In a preferable application, when the computer 88 (FIG. 1) informs the control circuit 40 of monochromatic printing, the control circuit 40 of the printer 20 (more specifically, the positional misalignment correction unit 210 shown in FIG. 5) corrects the positional misalignment in the course of bidirectional printing with only the second correction value.

The procedure of the first embodiment is the processing flow discussed above. The following describes the method of determining the correction values for the black nozzle arrays and the color nozzle arrays in detail.

(2) Method of Determining Correction Value for Black Nozzle Arrays

Figure 6:
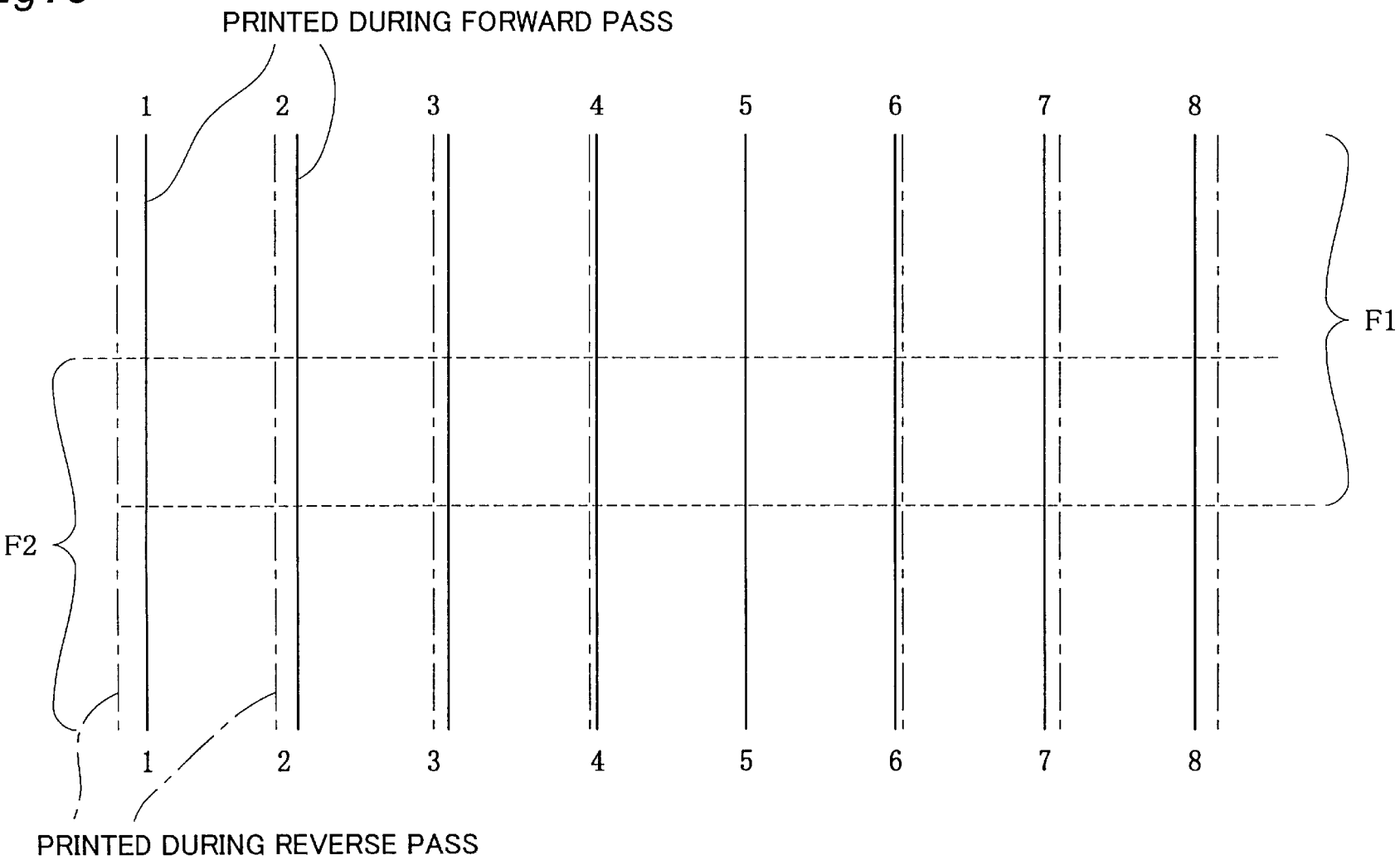
FIG. 6 shows a method of determining the correction value used for adjusting the positional misalignment, based on a test pattern in the first embodiment.

FIG. 6 shows a method of determining the correction value used for adjusting the positional misalignment, based on a test pattern. The test pattern is printed without any feed in the sub-scanning direction by the nozzles in the black nozzle arrays $K_1$, $K_2$, and $K_3$ forming dots on the printing medium P while the print head 28 is moving back and forth in the main scanning direction. On the forward pass, ink droplets are ejected to form ruled lines extending in the sub-scanning direction at fixed intervals on the printing medium P. In the example of FIG. 6, the solid lines with numerals 1 through 8 allocated thereto represent the ruled lines printed on the forward pass. Here these ruled lines are formed by the respective nozzles in the black nozzle arrays $K_1$, $K_2$, and $K_3$ ejecting ink droplets as the continuous straight lines extending in the sub-scanning direction at the resolution of 360 dpi The ruled lines printed on the backward pass is also formed likewise.

On the backward pass, the ruled lines are printed at different timings, that is, at several different printing positions, so that user can select the "timing of recording a ruled line completely overlapping the ruled line recorded on the forward pass." In the example of FIG. 6, as a matter of convenience, the ruled lines printed on the backward pass are shown by the broken lines. In this example, the ruled line that is formed by ink droplets ejected on the backward pass at the "theoretical timing to record the same ruled line" is the fourth left ruled line. The three left ruled lines from the third to the leftmost ruled line are printed at gradually delayed ejection timings of ink droplets, so that the lines are formed on the backward pass sequentially shifted leftward from those formed on the forward pass. The four right ruled lines from the fifth to the rightmost ruled line are printed at gradually advanced ejection timings of ink droplets, on the other hand, so that the lines are formed on the backward pass sequentially shifted rightward from those formed on the forward pass. This results in the test pattern printed on the printing medium P by one set of the forward pass and the backward pass of the main scan as shown in FIG. 6. The ruled lines Nos. 1 through 8 printed on the backward pass are shifted rightward sequentially from the left end by one dot pitch relative to the corresponding ruled lines printed on the forward pass. The correction value is accordingly set as an integral multiple of the dot pitch. In the example of FIG. 6, the ruled lines formed on the backward pass are shown by the broken lines. This is only for the purpose of distinguishing the ruled lines formed on the backward pass from those formed on the forward pass and does not necessarily mean that the ruled lines are actually printed in broken line on the backward pass.

In the process of printing the test pattern, numerals representing misalignment adjustment numbers (Nos. 1 to 8 in FIG. 6) are actually printed above and below plural sets of vertical ruled lines. The misalignment adjustment numbers have the function as the correction information representing the favorable correction state. Here the expression of "favorable correction state" means the state giving a minimum positional misalignment of dots in the main scanning direction formed by the forward pass and by the backward pass, when the recording position (or the recording timing) of either the forward pass or the backward pass is corrected with an adequate correction value. The test pattern is printed without any pass of the sub-scan, but the upper and lower numerals representing the misalignment adjustment numbers may be printed with the sub-scan.

The procedure of this embodiment prints the eight sets of the ruled lines. It is preferable to increase the number of printed sets of ruled lines if a large positional misalignment is expected, and it is preferable to reduce the number of printed sets of ruled lines if a small positional misalignment is expected. In the description above, the misalignment adjustment numbers increase in an ascending order from the leftmost end. But any numbers are allocated as long as the correction state can be specified. The magnitude(size) of each numeral shown in FIG. 6 do not reflect the actual ratio of the magnitude to the test pattern in any sense.

This procedure prints the ruled lines on the backward pass while varying the ejection timing of ink droplets by both the advancing and delaying amounts from the theoretical value to a plurality of different patterns. On the theoretical basis, the fourth left ruled line formed on the backward pass is expected to be coincident with the ruled line formed on the forward pass. In the actual state, however, as shown in FIG. 6, the fifth left ruled line formed on the backward pass (at the slightly advanced ejection timing of ink droplets relative to the theoretical timing) is coincident with the ruled line formed on the forward pass. The ejection timing of ink droplets applied to form the fifth left ruled line enables dots to be actually recorded at a same position when ink ejection aims at the same recording position in both the forward pass and the backward pass. This timing is stored as the correction value and is applied for actual printing. This arrangement ensures the adequate correction of the recording positions.

(3) Method of Determining Correction Values for Color Nozzle Arrays

The method of determining the correction values with regard to the color nozzle arrays is mentioned briefly. A similar procedure to that for the black nozzle arrays K is applicable to print test patterns with regard to the color nozzle arrays CMY and determine correction values. In the case of the color nozzle arrays CMY, each pass of the main scan forms dots only at the resolution of 120 dpi. In order to print continuous straight lines extending in the sub-scanning direction at the resolution of 360 dpi, three passes of the main scan in combination with the sub-scan by the feeding amount of 1 dot are required.

(4) Effects of Embodiment

In the technique of this embodiment, the correction values used for correcting the misalignment of recording positions are determined not on the basis of deductive inference but on the basis of the test patterns actually printed on the printing medium. The correction values can be determined adequately to relieve the actual printing misalignment.

The procedure of the embodiment prints the test patterns with little error and determines the correction values accurately. With regard to the black nozzles, the test pattern is printed without any feed in the sub-scanning direction. This effectively prevents the working error of each mechanism relating to the sub-scan feed from being reflected on the printed test pattern and from undesirably making the correction value contain some error. With regard to the color nozzles, although some feeds in the sub-scanning direction are required to print the contiguous dots in the sub-scanning direction, the feeding amount for this purpose is significantly smaller than the feeding amount required to print the test pattern shifted in the sub-scanning direction. This also ensures the printed test patterns with little error and accordingly enables the correction values to be determined accurately, based on the printed test patterns with little error.

In the case of color printing, the correction is carried out with the mean of the respective correction values of the color nozzle arrays and the black nozzle arrays (that is, the mean of the first correction values and the second correction value). In the case of monochromatic printing, on the other hand, the correction is carried out with only the correction value for the black nozzle arrays (that is, the second correction value). This arrangement ensures the optimum corrections in the respective print modes.

The positional misalignment of dots recorded with yellow ink is rather inconspicuous. There is accordingly little necessity of taking the correction value corresponding to the yellow nozzle group into account in the process of calculating the mean correction value. The method of taking the correction value for the yellow nozzle group into account equivalently with those of the other color nozzle groups, for example, cyan and magenta, may even cause the recording positions of cyan and magenta dots to be deviated from their optimum positions. In such cases, the adverse effect on the print image quality due to deviation of the recording positions of cyan and magenta dots from their optimum positions is predominant over the improvement in the quality due to adjustment of recording positions of yellow dots to the optimum positions. This lowers the print image quality of the resulting printed image as a whole. The arrangement of this embodiment does not take the correction value (the first correction value), corresponding to the yellow nozzle group, into account in the process of calculating the mean correction value. The technique of the embodiment is thus free from the above problem and ensures the high print image quality of the resulting printed image.

In the case of color printing, the technique of the embodiment carries out the correction with the mean of the respective correction values of the cyan nozzle array C, the magenta nozzle array M, and the black nozzle arrays K (that is, the mean of the first correction values and the second correction value). The nozzle arrays to be considered are not restricted to this combination. When black nozzles are not used so often in color printing, the correction may be carried out with the mean of only the correction values of the cyan nozzle array C and the magenta nozzle array M. The yellow nozzle array Y may additionally be taken into account, when suitable. In the above embodiment, the simple arithmetic mean (average) of the correction values of the respective nozzle arrays is set to the comprehensive correction value. The comprehensive correction value may, however, be the weighted average of the respective correction values. Weights to the first correction values and the second correction value may be set by taking into account the frequency in use of the color inks, yellow, cyan, and magenta, and the black ink, the distance from the center of the nozzle array, and the degree of conspicuousness of the misaligned recording position, and the weighted average may be calculated as the comprehensive correction value. The comprehensive correction value may alternatively be the geometric mean. Namely the misalignment of recording positions in the main scanning direction may be corrected in the course of bidirectional printing based on the first and the second correction values, without limitations on the method of using the first and the second correction values.

The test pattern is not restricted to the vertical ruled lines but other test patterns may be used instead, such as linear patterns where dots are recorded intermittently. Any positional misalignment test pattern may be usable as long as the test pattern enables selection of correction information representing a favorable correction state and subsequent determination of the correction value according to the correction information. In the case where the test pattern is the linear pattern where dots are recorded intermittently, even the nozzles that are not capable of forming contiguous dots in the sub-scanning direction can form the test pattern by only one pass of the main scan without carrying out the sub-scan.

In the arrangement of this embodiment, each of the color nozzle arrays that can form dots at the maximum resolution of 120 dpi and does not complete contiguous dots at the resolution of 360 dpi by one pass of the main scan is set as the low density nozzle group. Each of the black nozzle arrays that can form contiguous dots at the resolution of 360 dpi by only one pass of the main scan is set as the high density nozzle group. The technique of the present invention is, however, not restricted to these combinations of the ink colors with the recording densities, but is applicable to any combinations. For example, the technique is applicable to a printing apparatus that has with regard to an identical color ink both a high density nozzle group for high-performance printing and a low density nozzle group for low-performance printing. The low density nozzle group may be any nozzle group or nozzle array that forms only noncontiguous dots in the sub-scanning direction on the printing medium by one pass of the main scan at a predetermined recording density. The high density nozzle group may be any nozzle group or nozzle array that forms contiguous dots in the sub-scanning direction on the printing medium by one pass of the main scan at the predetermined recording density. The chromatic color nozzle groups are not restricted to the combination of cyan, magenta, and yellow, but may be, for example, a combination of light cyan, dark cyan, light magenta, dark magenta, and yellow.

D. Second Embodiment

Figure 7:
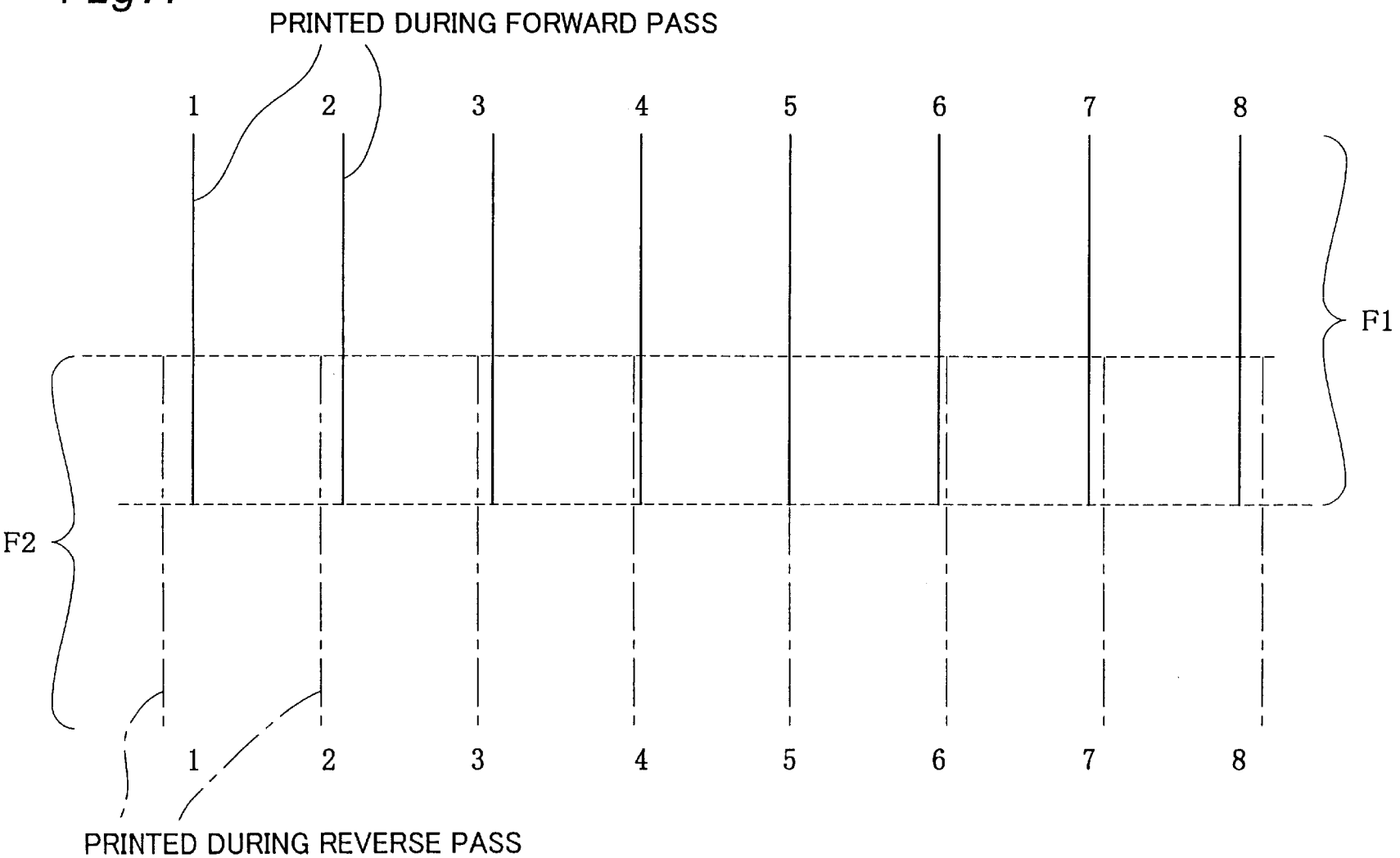
FIG. 7 shows another method of determining the correction value used for adjusting the positional misalignment, based on a test pattern in a second embodiment.

FIG. 7 shows a test pattern used in a second embodiment. The technique of the second embodiment prints only an upper part F1 of the ruled lines shown in FIG. 6 on the forward pass of the main scan using nozzles in a backward section of each nozzle array in the sub-scanning direction, while printing only a lower part F2 on the backward pass of the main scan using nozzles in a forward section of each nozzle array in the sub-scanning direction. The nozzles used on the forward pass partly overlap the nozzles used on the backward pass. This gives the printed test pattern as shown in FIG. 7. The configuration of the second embodiment is otherwise same with that of the first embodiment.

As clearly understood from the illustration of FIG. 7, in the technique of this embodiment, the printing positions of the ruled lines on the backward pass are shifted in the sub-scanning direction from the printing positions of the ruled lines on the forward pass. This arrangement makes it easy to discriminate the ruled lines having the high degree of coincidence and thereby to select the correction information representing the favorable correction state. The nozzles used on the forward pass partly overlap the nozzles used on the backward pass, so that the ruled lines printed on the forward pass partly overlap those on the backward pass. This further facilitates the discrimination of the ruled lines having the high degree of coincidence. This arrangement prints the test pattern not with all the nozzles but with only part of the nozzles and thereby desirably saves ink required for printing the test pattern.

Figure 8:
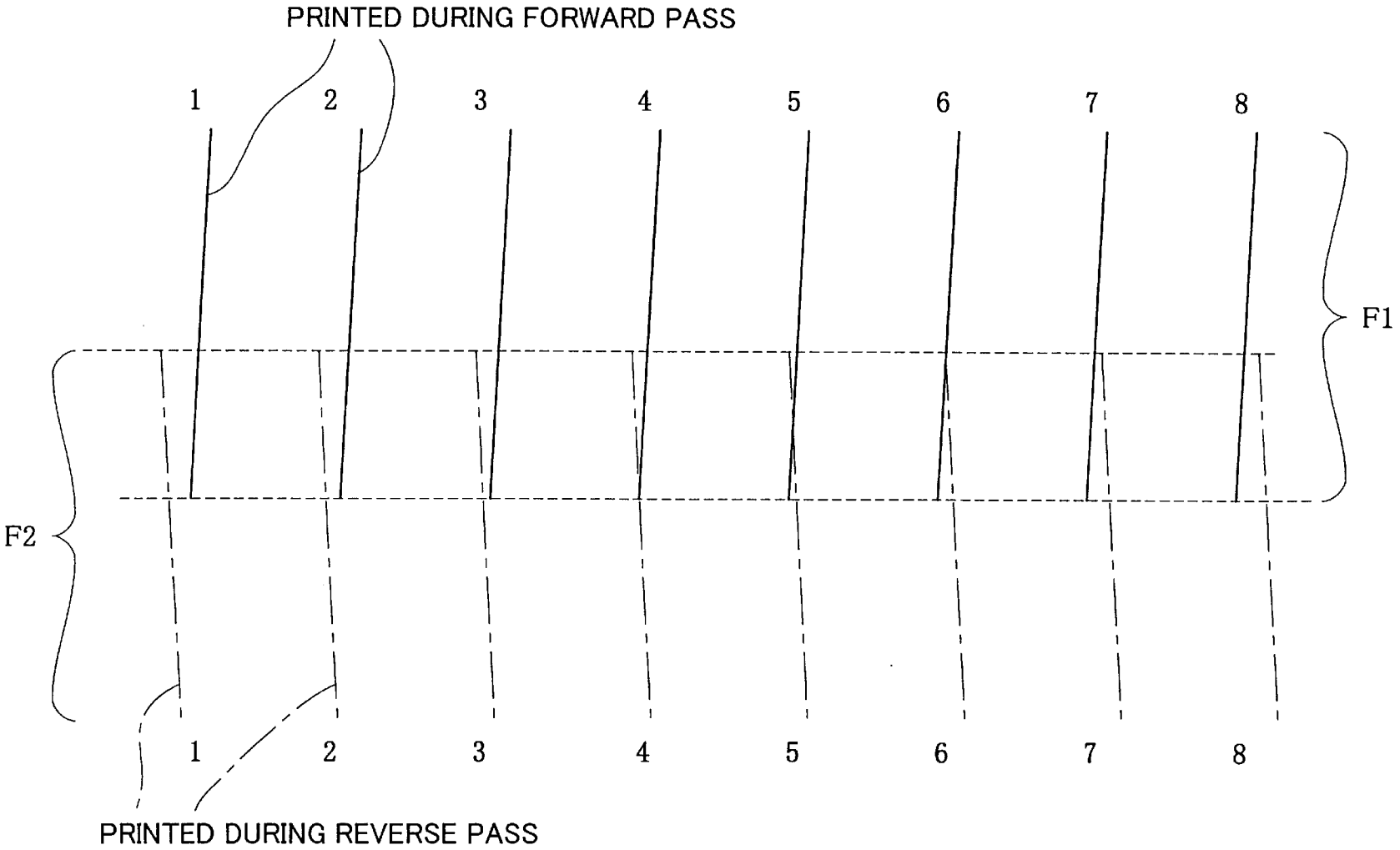
FIG. 8 shows the method of determining the correction value used for adjusting the positional misalignment, based on the test pattern in the second embodiment.

The technique of the embodiment prints the test pattern of the vertical ruled lines shifted in the sub-scanning direction without sub-scan feed. The overlapped portion of the vertical ruled lines (the part surrounded by the broken line in FIG. 7) is accordingly printed with the nozzles located around the center of the nozzle array. Even when the inclined angle of the print head on the backward pass is different from that on the forward pass, for example, due to the backlash of the driving mechanism, the overlapped portion of the vertical ruled lines properly reflects the displacement of the whole print head as shown in FIG. 8. This arrangement enables the correction value to be determined accurately, based on the test patter, even when the print head is inclined at different angles on the forward pass and on the backward pass. In the case where the set of ruled lines printed with the nozzles located in one end of the nozzle array are set as the reference, the correction value determined to reduce the positional misalignment on the one end of the nozzle array may enhance the positional misalignment on the other end. The technique of the embodiment enables the correction value to be determined on the basis of the overlapped portion of the ruled lines printed with the nozzles located around the center of the nozzle array. This arrangement is accordingly free from the above problem of the enhanced misalignment. Determination of the correction value based on the reference set of the vertical ruled lines with Number 5 in FIG. 8 reduces not only the positional misalignment of dot formation by the nozzles around the center of the nozzle array but equally decreases the positional misalignment of dot formation by the nozzles on both ends of the nozzle array (the upper and lower ends in FIG. 8).

The rear nozzle sub-group that is used to print the upper part F1 of the ruled lines and the front nozzle sub-group that is used to print the lower part F2 of the ruled lines may be selected arbitrarily as long as they satisfy the following requirements. The front nozzle sub-group are part of the nozzle group and include nozzles located in a relatively forward portion of the nozzle group in the sub-scanning direction, and the rear nozzle sub-group are part of the nozzle group and include nozzles located in a relatively backward portion of the nozzle group in the sub-scanning direction. The top and the bottom of the actual printing positions on the printing medium may be inverted. The front nozzle sub-group and the rear nozzle sub-group may have some common nozzles as in the case of this embodiment or may alternatively have no common nozzles. In other words, the ruled lines printed on the forward pass may or may not overlap with the ruled lines printed on the backward pass in the sub-scanning direction.

E. Third Embodiment

Figure 9:
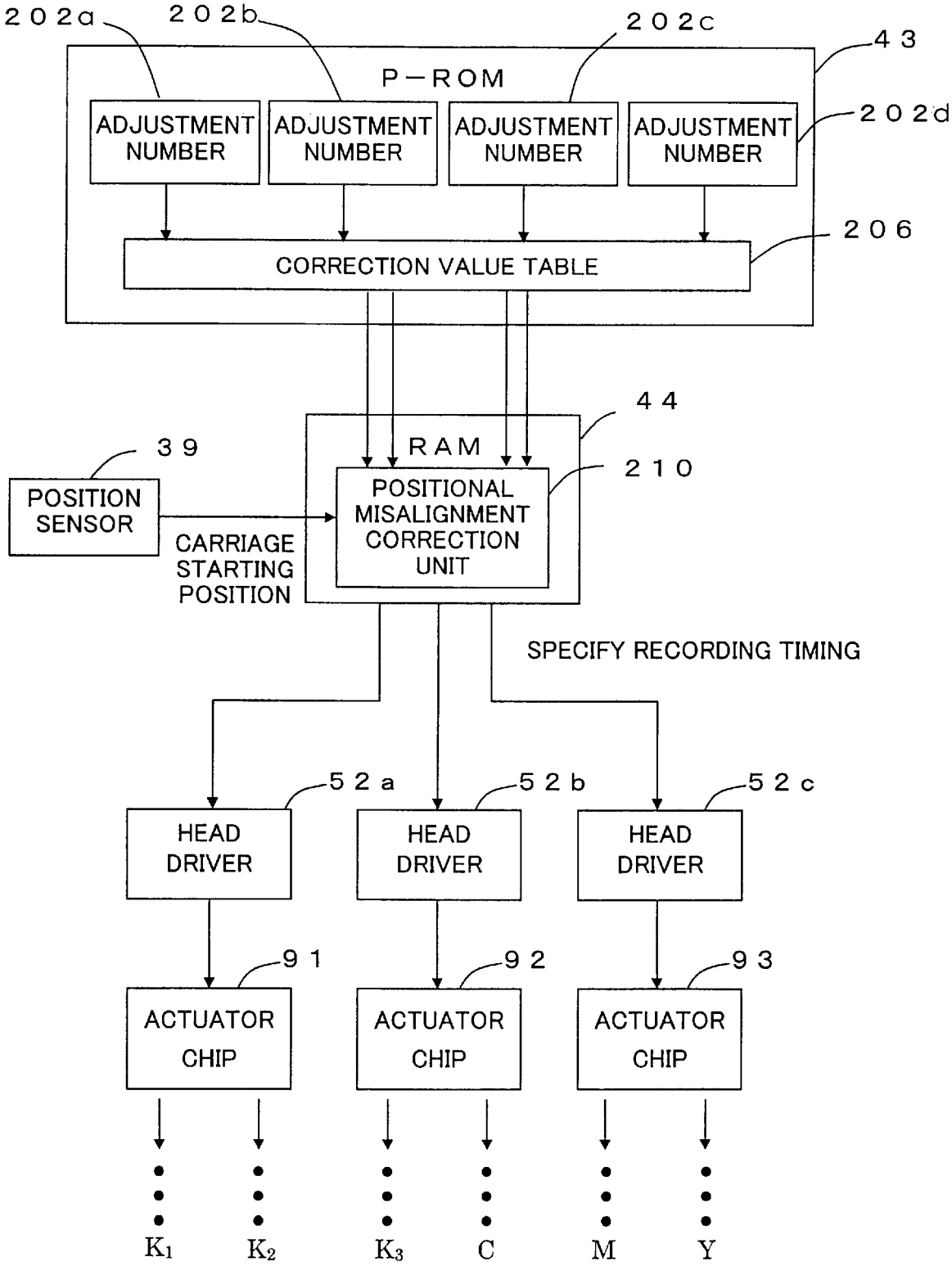
FIG. 9 is a block diagram illustrating the main configuration relating to the correction of positional misalignment in bidirectional printing in a third embodiment.

FIG. 9 is a block diagram illustrating the main configuration relating to the correction of positional misalignment in the course of bidirectional printing in a third embodiment. The difference from the structure shown in FIG. 5 is that the structure of FIG. 9 has independent head drivers 52*a*, 52*b*, and 52*c* for respectively driving three actuators 91, 92, and 93. In the structure of the third embodiment, the three actuator chips 91, 92, and 93 are independently driven by the three head drivers 52*a*, 52*b*, and 52*c*. Instructions of recording timing transmitted from the positional misalignment correction unit 210 are thus given individually to the respective head drivers 52*a*, 52*b*, and 52*c*. Correction of the positional misalignment in the course of bidirectional printing is accordingly carried out for each of the actuator chips.

The third embodiment is characterized by the arrangement of independently setting the correction value for each actuator chip. This arrangement enables correction of the positional misalignment for each actuator chip and thereby corrects the positional misalignment to a better level in the case of bidirectional printing. In a printer which has actuator chips driving respectively three nozzle arrays, the correction value may be set independently for each three nozzle arrays.

The present invention is not restricted to the above embodiments or their modifications, but there may be many other modifications, changes, and alterations without departing from the scope or spirit of the main characteristics of the present invention. Some examples of possible modification are given below.

(1) It is preferable to set the correction value individually for each nozzle array. This arrangement further reduces the positional misalignment, compared with the arrangement of the embodiment discussed above.

(2) The technique of the embodiment adjusts the target position of dots (or the recording timing) in order to correct the positional misalignment. Other methods may be applied to correct the positional misalignment. One applicable procedure adjusts the frequency of the driving signal transmitted to the actuator chip to correct the positional misalignment.

(3) The technique of the embodiment adjusts the target position (or the recording timing) on the backward pass to correct the positional misalignment. One modified procedure adjusts the target position on the forward pass to correct the positional misalignment. Another modified procedure adjusts both the target positions on the forward pass and on the backward pass to correct the positional misalignment. In general, the positional misalignment is corrected by adjusting at least one of the target positions on the forward pass and on the backward pass.

(4) Although ink jet printers are described in the above embodiments, the present invention is not restricted to the ink jet printers but may be applicable to a variety of printing apparatuses that generally carry out printing with a print head.

What is claimed is:

1. A printing apparatus that carries out bidirectional, reciprocating main scan to effect printing on a printing medium, the printing apparatus comprising:

a print head having a nozzle group that ejects ink droplets to record dots on the printing medium;

a memory that stores a correction value, the correction value being used to correct misalignment of recording positions in a main scanning direction on a forward pass and a backward pass of the main scan; and a positional misalignment correction unit that corrects, using the correction value, the misalignment of recording positions in the main scanning direction occurring in bidirectional printing, wherein the correction value is determined according to correction information that represents a favorable correction state selected based on a positional misalignment test pattern, the positional misalignment test pattern including a rear test sub-pattern and a front test sub-pattern printed at different positions shifted in a sub-scanning direction, the front test sub-pattern being printed with a front nozzle sub-group on the printing medium on a selected one of the forward pass and the backward pass of the main scan of the print head, the front nozzle sub-group being not an entirety but part of the nozzle group and including nozzles located in a relatively forward section of the nozzle group in the sub-scanning direction, the front nozzle sub-group being selected to eject a first identical color ink, the rear test sub-pattern being printed with a rear nozzle sub-group on the printing medium on the other of the forward pass and the backward pass of the main scan of the print head, the rear nozzle sub-group being not the entirety but part of the nozzle group and including nozzles located in a relatively backward section of the nozzle group in the sub-scanning direction, the rear nozzle sub-group being selected to eject a second identical color ink, wherein at least one nozzle in the rear nozzle sub-group is not in the front nozzle sub-group, and at least one nozzle in the front nozzle sub-group is not in the rear nozzle sub-group, and the relatively forward and backward sections respectively cover a same range in the sub-scanning direction.

2. A printing apparatus in accordance with claim 1, wherein the nozzle group comprises a low density nozzle group that forms only noncontiguous dots in the sub-scanning direction at a predetermined recording density on the printing medium by one pass of the main scan, and the memory stores a first correction value, the first correction value being used to correct misalignment of recording positions in the main scanning direction on the forward pass and the backward pass of the main scan with regard to the low density nozzle group, the first correction value being determined according to correction information that represents a favorable correction state selected based on a first positional misalignment test pattern, the first positional misalignment test pattern including a first front test sub-pattern and a first rear test sub-pattern printed with the low density nozzle group at different positions shifted in the sub-scanning direction, the first front test sub-pattern comprising a plurality of vertical ruled lines that extend in the sub-scanning direction and are formed using a first front nozzle sub-group by repeatedly carrying out a selected one of the forward pass and the backward pass of the main scan of the print head in combination with sub-scan feeds interposed between the main scan passes, the first front nozzle sub-group being part of the low density nozzle group and including nozzles located in a relatively forward section of the low density nozzle group in the sub-scanning direction, the first rear test sub-pattern comprising a plurality of vertical ruled lines that extend in the sub-scanning direction and are formed using a first rear nozzle sub-group by repeatedly carrying out the other of the forward pass and the backward pass of the main scan of the print head in combination with sub-scan feeds interposed between the main scan passes, the first rear nozzle sub-group being part of the low density nozzle group and including nozzles located in a relatively backward section of the low density nozzle group in the sub-scanning direction.

3. A printing apparatus in accordance with claim 2, wherein a feeding amount of the sub-scan in printing the first positional misalignment test pattern is equal to one dot pitch.

4. A printing apparatus in accordance with claim 1, wherein the nozzle group comprises a high density nozzle group that forms contiguous dots in the sub-scanning direction at a predetermined recording density on the printing medium by one pass of the main scan, and the memory stores a second correction value, the second correction value being used to correct misalignment of recording positions in the main scanning direction on the forward pass and the backward pass of the main scan with regard to the high density nozzle group, the second correction value being determined according to correction information that represents a favorable correction state selected based on a second positional misalignment test pattern, the second positional misalignment test pattern including a second front test sub-pattern and a second rear test sub-pattern printed with the high density nozzle group at different positions shifted in the sub-scanning direction, the second front test sub-pattern comprising a plurality of vertical ruled lines of continuous dots that extend in the sub-scanning direction and are formed using a second front nozzle sub-group on a selected one of the forward pass and the backward pass of the main scan of the print head, the second front nozzle sub-group being part of the high density nozzle group and the second front nozzle sub-group including nozzles located in a relatively forward section of the high density nozzle group in the sub-scanning direction, the second rear test sub-pattern comprising a plurality of vertical ruled lines of continuous dots that extend in the sub-scanning direction and are formed using a second rear nozzle sub-group on the other of the forward pass and the backward pass of the main scan of the print head, the second rear nozzle sub-group being part of the high density nozzle group and the second rear nozzle sub-group including nozzles located in a relatively backward section of the high density nozzle group in the sub-scanning direction, the second positional misalignment test pattern being printed without sub-scan feed.

5. A printing apparatus in accordance with claim 1, wherein the nozzle group comprises:

a low density nozzle group that forms only noncontiguous dots in the sub-scanning direction as a predetermined recording density on the printing medium by one pass of the main scan; and a high density nozzle group that forms contiguous dots in the sub-scanning direction at the predetermined recording density on the printing medium by one pass of the main scan, the memory stores a first correction value and a second correction value, and the positional misalignment correction unit corrects the misalignment of recording positions in the main scanning direction occurring in bidirectional printing, using a mean of the first correction value and the second correction value.

6. A printing apparatus in accordance with claim 5, wherein the high density nozzle group ejects black ink, and the low density nozzle group comprises a plurality of chromatic color nozzle groups, each ejecting a chromatic color ink, the first correction value is determined individually for at least one chromatic color nozzle group selected among the plurality of chromatic color nozzle groups, and the positional misalignment correction unit corrects the misalignment of recording positions in the main scanning direction occurring in bidirectional printing, using a mean of at least two correction values selected out of the second correction value and the at least one first correction value determined for the at least one selected chromatic color nozzle group, in a specific print mode in which nozzles in the low density nozzle group are used.

7. A printing apparatus in accordance with claim 1, wherein the nozzle group comprises:

a low density nozzle group that forms only noncontiguous dots in the sub-scanning direction at a predetermined recording density on the printing medium by one pass of the main scan; and a high density nozzle group that forms contiguous dots in the sub-scanning direction at the predetermined recording density on the printing medium by one pass of the main scan, the memory stores a first correction value and a second correction value, the high density nozzle group ejecting black ink, the low density nozzle group comprising a plurality of chromatic color nozzle groups, each ejecting a chromatic color ink, a first correction value being determined for at least one chromatic color nozzle group selected among the plurality of chromatic color nozzle groups, and the positional misalignment correction unit corrects the misalignment of recording positions using one of the first correction values in a specific print mode in which nozzles in the low density nozzle group are used.

8. A printing apparatus in accordance with claim 1, wherein the nozzle group comprises:

a low density nozzle group that forms only noncontiguous dots in the sub-scanning direction at a predetermined recording density on the printing medium by one pass of the main scan; and a high density nozzle group that forms contiguous dots in the sub-scanning direction at the predetermined recording density on the printing medium by one pass of the main scan, the memory stores a first correction value and a second correction value, the high density nozzle group ejecting black ink, the low density nozzle group comprising a plurality of chromatic color nozzle groups, each ejecting a chromatic color ink, and the positional misalignment correction unit corrects the misalignment of recording positions using the second correction value in a specific print mode in which nozzles in the low density nozzle group are not used.

9. A printing apparatus in accordance with claim 1, wherein the nozzle group comprises:

a low density nozzle group that forms only noncontiguous dots in the sub-scanning direction at a predetermined recording density on the printing medium by one pass of the main scan; and a high density nozzle group that forms contiguous dots in the sub-scanning direction at the predetermined recording density on the printing medium by one pass of the main scan, the memory stores a first correction value and a second correction value; and the positional misalignment correction unit corrects the misalignment of recording positions using the first correction value with regard to the low density nozzle group, and corrects the misalignment of recording positions using the second correction value with regard to the high density nozzle group.

10. A printing apparatus in accordance with claim 1, wherein the positional misalignment test pattern includes a plurality of test sub-pattern pairs printed at different positions in the main scanning direction, each sub-pattern pair including the rear test sub-pattern and the front test sub-pattern printed at different positions shifted in a sub-scanning direction, the plurality of test sub-pattern pairs being printed with different correction values, respectively.

11. The printing apparatus of claim 1, wherein the front test sub-pattern includes all dots printed on the selected one of the forward pass and the backward pass, and the rear test sub-pattern includes all dots printed on the other of the forward pass and the backward pass.

12. The printing apparatus of claim 1, wherein the first identical color ink and the second identical color ink have a same color.

13. The printing apparatus of claim 1, wherein the first identical color ink is a different color than the second identical color ink.

14. In a printing apparatus that comprises a print head having a nozzle group which ejects ink droplets to record dots on a printing medium, the printing apparatus carrying out bidirectional, reciprocating main scan to complete printing on the printing medium, a method of correcting misalignment of recording positions of ink droplets in a main scanning direction on a forward pass and a backward pass of the main scan, the method comprising the steps of:

(a) printing a front test sub-pattern with a front nozzle sub-group on the printing medium on a selected one of the forward pass and the backward pass of the main scan of the print head, the front nozzle sub-group being not an entirety but part of the nozzle group and including nozzles located in a relatively forward section of the nozzle group in a sub-scanning direction, the front nozzle sub-group being selected to eject a first identical color ink, (b) printing a rear test sub-pattern with a rear nozzle sub-group on the printing medium on the other of the forward pass and the backward pass of the main scan of the print head, the rear nozzle sub-group being not the entirety but part of the nozzle group and including nozzles located in a relatively backward section of the nozzle group in the sub-scanning direction, the rear nozzle sub-group being selected to eject a second identical color ink, wherein at least one nozzle in the rear nozzle sub-group is not in the front nozzle sub-group, and at least one nozzle in the front nozzle sub-group is not in the rear nozzle sub-group, and the relatively forward and backward sections respectively cover a same range in the sub-scanning direction;

(c) determining a correction value according to correction information that represents a favorable correction state selected based on positional misalignment test pattern, the positional misalignment test pattern including the rear test sub-pattern and the front test sub-pattern printed at different positions shifted in the sub-scanning direction; and (d) correcting the misalignment of recording positions in the main scanning direction occurring in bidirectional printing, using the correction value.

15. The printing apparatus of claim 14, wherein the front test sub-pattern includes all dots printed on the selected one of the forward pass and the backward pass, and the rear test sub-pattern includes all dots printed on the other of the forward pass and the backward pass.

16. A recording medium that stores a computer program for causing a computer to correct misalignment of recording positions of ink droplets in a main scanning direction on a forward pass and a backward pass of a main scan, the computer connected to a printing apparatus that comprises a print head having a nozzle group which ejects ink droplets to record dots on a printing medium, and carries out the bidirectional, reciprocating main scan to complete printing on the printing medium, the computer program causing the computer to attain the functions of:

(a) printing a front test sub-pattern with a front nozzle sub-group on the printing medium on a selected one of the forward pass and the backward pass of the main scan of the print head, the front nozzle sub-group being not an entirety but part of the nozzle group and including nozzles located in a relatively forward section of the nozzle group in a sub-scanning direction, the front nozzle sub-group being selected to eject a first identical color ink;

(b) printing a rear test sub-pattern with a rear nozzle sub-group on the printing medium on the other of the forward pass and the backward pass of the main scan of the print head, the rear nozzle sub-group being not the entirety but part of the nozzle group and including nozzles located in a relatively backward section of the nozzle group in the sub-scanning direction, the rear nozzle sub-group being selected to eject a second identical color ink, wherein at least one nozzle in the rear nozzle sub-group is not in the front nozzle sub-group, and at least one nozzle in the front nozzle sub-group is not in the rear nozzle sub-group, and the relatively forward and backward sections respectively cover a same range in the sub-scanning direction;

(c) determining a correction value according to correction information that represents a favorable correction state selected based on a positional misalignment test pattern, the positional misalignment test pattern including the rear test sub-pattern and the front test sub-pattern printed at different positions shifted in the sub-scanning direction; and (d) correcting the misalignment of recording positions in the main scanning direction occurring in bidirectional printing, using the correction value.

17. The printing apparatus of claim 16, wherein the front test sub-pattern includes all dots printed on the selected one of the forward pass and the backward pass, and the rear test sub-pattern includes all dots printed on the other of the forward pass and the backward pass.

18. In a printing apparatus that comprises a print head having a nozzle group which ejects ink droplets to record dots on a printing medium, the printing apparatus carrying out bidirectional, reciprocating main scan to complete printing on the printing medium, a method of correcting misalignment of recording positions of ink droplets in a main scanning direction on a forward pass and a backward pass of the main scan, the method comprising the steps of:

(a) printing a positional misalignment test pattern including a plurality of test sub-pattern pairs at different positions in the main scanning direction, each test sub-pattern pair including a rear test sub-pattern and a front test sub-pattern printed at different positions shifted in the sub-scanning direction, the plurality of test sub-pattern pairs being printed with different correction values, respectively;

(b) determining a correction value according to correction information that represents a favorable correction state selected based on the positional misalignment test pattern; and (c) correcting the misalignment of recording positions in the main scanning direction occurring in bidirectional printing, using the correction value, wherein the step (a) includes the steps of, (a1) printing the front test sub-patterns with a front nozzle sub-group on a printing medium on a selected one of the forward pass and the backward pass of the main scan of the print head, the front nozzle sub-group being part of the nozzle group and including nozzles located in a relatively forward section of the nozzle group in a sub-scanning direction, the front nozzle sub-group being selected to eject a first identical color ink, and (a2) printing the rear test sub-patterns with a rear nozzle sub-group on the printing medium on the other of the forward pass and the backward pass of the main scan of the print head, the rear nozzle sub-group being part of the nozzle group and including nozzles located in a relatively backward section of the nozzle group in the sub-scanning direction, the rear nozzle sub-group being selected to eject a second identical color ink, wherein at least one nozzle in the rear nozzle sub-group is not in the front nozzle sub-group, and at least one nozzle in the front nozzle sub-group is not in the rear nozzle sub-group, and the relatively forward and backward sections respectively cover a same range in the sub-scanning direction.

19. The printing apparatus of claim 18, wherein the front test sub-pattern includes all dots printed on the selected one of the forward pass and the backward pass, and the rear test sub-pattern includes all dots printed on the other of the forward pass and the backward pass.

20. A recording medium that stores a computer program for causing a computer to correct misalignment of recording positions of ink droplets in a main scanning direction on a forward pass and a backward pass of main scan, the computer connected to a printing apparatus that comprises a print head having a nozzle group which ejects ink droplets to record dots on a printing medium, and carries out the bidirectional, reciprocating main scan to complete print on the printing medium, the computer program causing the computer to attain the functions of:

(a) printing a positional misalignment test pattern including a plurality of test sub-pattern pairs at different positions in the main scanning direction, each test sub-pattern pair including a rear test sub-pattern and a front test sub-pattern printed at different positions shifted in the sub-scanning direction, the plurality of test sub-pattern pairs being printed with different correction values, respectively;

(b) determining a correction value according to correction information that represents a favorable correction state selected based on the positional misalignment test pattern; and (c) correcting the misalignment of recording positions in the main scanning direction occurring in bidirectional printing, using the correction value, wherein the step (a) includes the steps of, (a1) printing the front test sub-patterns with a front nozzle sub-group on a printing medium on a selected one of the forward pass and the backward pass of the main scan of the print head, the front nozzle sub-group being part of the nozzle group and including nozzles located in a relatively forward section of the nozzle group in a sub-scanning direction, the front nozzle sub-group being selected to eject a first identical color ink, and (a2) printing the rear test sub-patterns with a rear nozzle sub-group on the printing medium on the other of the forward pass and the backward pass of the main scan of the print head, the rear nozzle sub-group being part of the nozzle group and including nozzles located in a relatively backward section of the nozzle group in the sub-scanning direction, the rear nozzle sub-group being selected to eject a second identical color ink, wherein at least one nozzle in the rear nozzle sub-group is not in the front nozzle sub-group, and at least one nozzle in the front nozzle sub-group is not in the rear nozzle sub-group, and the relatively forward and backward sections respectively cover a same range in the sub-scanning direction.

21. The printing apparatus of claim 20, wherein the front test sub-pattern includes all dots printed on the selected one of the forward pass and the backward pass, and the rear test sub-pattern includes all dots printed on the other of the forward pass and the backward pass.

* * * * *